US010861377B2

(12) United States Patent
Huang

(10) Patent No.: US 10,861,377 B2
(45) Date of Patent: Dec. 8, 2020

(54) GAMMA VOLTAGE CORRECTION CIRCUIT, METHOD AND DISPLAY DEVICE

(71) Applicant: HKC Corporation Limited, Guangdong (CN)

(72) Inventor: Xiaoyu Huang, Guangdong (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/247,752

(22) Filed: Jan. 15, 2019

(65) Prior Publication Data

US 2020/0135088 A1 Apr. 30, 2020

Related U.S. Application Data

(63) Continuation of application No. PCT/CN2018/115899, filed on Nov. 16, 2018.

(30) Foreign Application Priority Data

Oct. 24, 2018 (CN) ..... 2018 1 1236744

(51) Int. Cl.
*G06F 1/00* (2006.01)
*G09G 3/30* (2006.01)
*G09G 3/36* (2006.01)

(52) U.S. Cl.
CPC ..... *G09G 3/30* (2013.01); *G09G 3/36* (2013.01); *G09G 2320/0673* (2013.01)

(58) Field of Classification Search
CPC . G09G 5/10; G09G 3/02; G09G 3/025; G02B 26/08
See application file for complete search history.

(56) References Cited

U.S. PATENT DOCUMENTS 9,761,163 B2 * 9/2017 Ohyama ..... G02B 26/085
2012/0162272 A1 * 6/2012 Lee ..... G09G 5/10 345/690
2016/0365019 A1 12/2016 Lee et al.

FOREIGN PATENT DOCUMENTS

| | | | |
|---|---|---|---|
| CN | 1405745 | A | 3/2003 |
| CN | 101533594 | A | 9/2009 |
| CN | 104409048 | A | 3/2015 |
| CN | 105321489 | A | 2/2016 |
| CN | 106710560 | A | 5/2017 |
| CN | 106782265 | A | 5/2017 |
| CN | 107331365 | A | 11/2017 |
| CN | 107978274 | A | 5/2018 |

* cited by examiner

*Primary Examiner* — Michael A Faragalla

(57) ABSTRACT

Disclosed is a gamma voltage correction circuit, selecting a compensation voltage corresponding to a data-driven signal satisfying an equilibrium condition from multi-channel compensation voltages when determining that data-driven signals output by the output module could not satisfy the equilibrium condition of the picture lightness.

15 Claims, 3 Drawing Sheets

GAMMA VOLTAGE CORRECTION CIRCUIT, METHOD AND DISPLAY DEVICE

CROSS REFERENCE TO RELATED APPLICATIONS

The present application is a Continuation Application of PCT Application No. PCT/CN2018/115899 filed on Nov. 16, 2018, which claims the benefit of Chinese Patent Application No. 201811236744.8 filed on Oct. 24, 2018. All the above are hereby incorporated by reference.

FIELD OF THE DISCLOSURE

The present application relates to the field of display technology, in particular, to a gamma voltage correction circuit, methods, and a display device.

BACKGROUND OF THE DISCLOSURE

With the development of science and technology, the integration level of the driving architecture of the display panel is also getting higher and higher, and the reference voltage generating module is also built in each Source-Chip on Film.

However, due to differences in semiconductor processes, reference voltage values generated by reference voltage generation modules in different Source-Chip on Films may also differ. The difference in the reference voltage value causes the voltage values output by the adjacent two Source-Chip on Films to be different, thereby causing a picture abnormality.

SUMMARY OF THE DISCLOSURE

The main purpose of the present application is to provide a gamma voltage correction circuit, methods and a display device, which aims to solve the problem that the difference between the reference voltage values causes the voltage values output by the adjacent two source drivers to be different, thereby causing abnormality of the picture.

To achieve the above object, the present application provides a gamma voltage correction circuit, the gamma voltage correction circuit includes:

a plurality of source drivers, each of the source drivers includes a first voltage generating module, a first voltage compensation module, a multi-channel selector module, and an output module, the first voltage generating module is configured to generate and output a multi-channel reference voltage;

the first voltage compensation module is configured to generate and output a multi-channel compensation voltage according to one channel of the reference voltages;

the multi-channel selector module is configured to output one channel of compensation voltages of the multi-channel compensation voltages;

the output module is configured to output a corresponding data-driven signal according to a compensation voltage output by the multi-channel selector module; and a timing controller configured to control the multi-channel selector module to select a compensation voltage corresponding to a data-driven signal satisfying an equilibrium condition from the multi-channel compensation voltages and output it to the output module when determining the data-driven signals output by the output module could not satisfy the equilibrium condition of the picture lightness.

Optionally, the timing controller is specifically configured to:

determine whether the data-driven signal output by the output module could satisfy the equilibrium condition of the picture lightness;

control the multi-channel selector module of the corresponding source driver to select another channel of compensation voltages from the multi-channel compensation voltages as the current compensation voltage to output to the output module, and return to continue to determine whether the data-driven signal output by the output module could satisfy the equilibrium condition of the picture lightness until the multi-channel selector module is controlled to select a compensation voltage corresponding to the data-driven signal satisfying the equilibrium condition from the multi-channel compensation voltages when determining that the data-driven signal output by the output module could not satisfy the equilibrium condition of the picture lightness.

Optionally, the determining whether the data-driven signal output by the output module could satisfy the equilibrium condition of the picture lightness is:

obtaining a data-driven signal output by two source drivers of the plurality of source drivers respectively, and calculating the difference between the obtained voltage values of the two data-driven signals; and determining that the data-driven signal output by the output module could not satisfy the equilibrium condition of the picture lightness when the voltage difference between the two data-driven signals is greater than the preset difference.

Optionally, the timing controller is specifically configured to:

determine whether the data-driven signal output by the output module could satisfy the equilibrium condition of the picture lightness;

determine a corresponding compensation voltage value, and control the multi-channel selector module of the corresponding source driver to select a compensation voltage matching the compensation voltage value from the multi-channel compensation voltage according to the compensation voltage value and output it to the output module when determining that the data-driven signal output by the output module could not satisfy the equilibrium condition of the picture lightness.

Optionally, the first voltage compensation module includes a plurality of compensation resistors, and one end of the plurality of compensation resistors is connected to the first voltage generating module, and the other end of the plurality of compensation resistors is connected to the output ends of the multi-channel selector module one by one; the resistance values of the plurality of compensation resistors are proportionally disposed.

Optionally, the number of the compensation resistors is set to four.

Optionally, the resistance value of any one of the four compensation resistors is 0 ohm.

Optionally, each compensation voltage output by the first voltage compensation module is proportionally disposed.

The present invention further proposes a gamma reference voltage correction method, the gamma reference voltage correction method comprises the following steps:

a source driver generates a multi-channel reference voltage;

a multi-channel compensation voltage is generated according to one channel of the reference voltages;

one channel of compensation voltages of the multi-channel compensation voltage is output;

a corresponding data-driven signal is output according to the compensation voltage; and controlling, by the timing controller, a source driver to select a compensation voltage corresponding to a data-driven signal satisfying an equilibrium condition from the multi-channel compensation voltages and outputting the compensation voltage when determining that the data-driven signal could not satisfy the equilibrium condition of the picture lightness.

Optionally, the steps of the timing controller controlling a source driver to select and output a compensation voltage corresponding to a data-driven signal satisfying an equilibrium condition from the multi-channel compensation voltages when determining that the data-driven signal could not satisfy the equilibrium condition of the picture lightness includes:

determining, the timing controller, whether the data-driven signal output by the output module could satisfy the equilibrium condition of the picture lightness;

and controlling the multi-channel selector module of the corresponding source driver to select one channel of compensation voltages from the multi-channel compensation voltages as the current compensation voltage to output to the output module of the source driver, and returning to continue to determine whether the data-driven signal output by the output module could satisfy the equilibrium condition of the picture lightness until the multi-channel selector module is controlled to select the compensation voltage corresponding to the data-driven signal satisfying the equilibrium condition from the multi-channel compensation voltages when determining that the data-driven signal output by the output module could not satisfy the equilibrium condition of the picture lightness.

Optionally, the determining whether the data-driven signal output by the output module could satisfy the equilibrium condition of the picture lightness is:

obtaining a data-driven signal output by adjacent two source drivers respectively, and comparing the two data-driven signals obtained; and determining that the data-driven signal output by the output module could not satisfy the equilibrium condition of the picture lightness when the voltage difference between the two data-driven signals is greater than the preset difference.

Optionally, the steps of the timing controller controlling a source driver to select and output a compensation voltage corresponding to a data-driven signal satisfying an equilibrium condition from the multi-channel compensation voltages when determining that the data-driven signal could not satisfy the equilibrium condition of the picture lightness includes:

determining whether the data-driven signal output by the output module of the source driver could satisfy the equilibrium condition of the picture lightness; and determining a corresponding compensation voltage value, and control the multi-channel selector module of the corresponding source driver to select a compensation voltage matching the compensation voltage value from the multi-channel compensation voltage according to the compensation voltage value and output it to the output module when determining that the data-driven signal output by the output module could not satisfy the equilibrium condition of the picture lightness.

Optionally, each compensation voltage is proportionally disposed.

The present invention further proposes a display device, including a display panel and a gamma voltage correction circuit of the display panel as described above, a plurality of data lines of the display panel and the plurality of the source driver chips of the gamma voltage correction circuit are connected to each other respectively;

the gamma voltage correction circuit includes:

a plurality of source drivers, each of the source drivers includes a first voltage generating module, a first voltage compensation module, a multi-channel selector module, and an output module, the first voltage generating module is configured to generate and output a multi-channel reference voltage;

the first voltage compensation module is configured to generate and output a multi-channel compensation voltage according to one channel of the reference voltages;

the multi-channel selector module is configured to output one channel of compensation voltages of the multi-channel compensation voltages;

the output module is configured to output a corresponding data-driven signal according to a compensation voltage output by the multi-channel selector module; and a timing controller configured to control the multi-channel selector module to select a compensation voltage corresponding to a data-driven signal satisfying an equilibrium condition from the multi-channel compensation voltages and output it to the output module when determining the data-driven signals output by the output module could not satisfy the equilibrium condition of the picture lightness.

Optionally, the timing controller is specifically configured to:

determine whether the data-driven signal output by the output module could satisfy the equilibrium condition of the picture lightness; and control the multi-channel selector module of the corresponding source driver to select another channel of compensation voltages from the multi-channel compensation voltages as the current compensation voltage to output to the output module, and return to continue to determine whether the data-driven signal output by the output module could satisfy the equilibrium condition of the picture lightness until the multi-channel selector module is controlled to select a compensation voltage corresponding to the data-driven signal satisfying the equilibrium condition from the multi-channel compensation voltages when determining that the data-driven signal output by the output module could not satisfy the equilibrium condition of the picture lightness.

Optionally, the determining whether the data-driven signal output by the output module could satisfy the equilibrium condition of the picture lightness is:

obtaining a data-driven signal output by two source drivers of the plurality of source drivers respectively, and calculating the difference between the obtained voltage values of the two data-driven signals; and determining that the data-driven signal output by the output module could not satisfy the equilibrium condition of the picture lightness when the voltage difference between the two data-driven signals is greater than the preset difference.

Optionally, the timing controller is specifically configured to:

determine whether the data-driven signal output by the output module could satisfy the equilibrium condition of the picture lightness; and determine a corresponding compensation voltage value, and control the multi-channel selector module of the corresponding source driver to select a compensation voltage matching the compensation voltage value from the multi-channel compensation voltage according to the compensation voltage value and output it to the output module when determining that the data-driven signal output by the output module could not satisfy the equilibrium condition of the picture lightness.

Optionally, the first voltage compensation module includes a plurality of compensation resistors, and one end of the plurality of compensation resistors is connected to the first voltage generating module, and the other end of the plurality of compensation resistors is connected to the output ends of the multi-channel selector module one by one; the resistance values of the plurality of compensation resistors are proportionally disposed.

The gamma voltage correction circuit of the present application passes through a plurality of source drivers, and each of the source drivers is provided with a first voltage generating module, a first voltage compensation module, a multi-channel selector module and an output module to generate, by the first voltage generating module, a multi-channel reference voltage and output it to the first voltage compensation module, so that the first voltage compensation module generates and outputs a multi-channel compensation voltage according to one channel of the reference voltages. Further, after one channel of multi-channel compensation voltages is output by the multi-channel selector module, a video data signal output by the timing controller is converted into a gray-scale voltage data signal by means of the output module according to the compensation voltage, that is, output after the data-driven signal. The present application further determines whether the data-driven signal output by the output module could satisfy the equilibrium condition of the picture lightness by the timing controller and controls the multi-channel selector module of the corresponding source driver to select a compensation voltage corresponding to a data-driven signal satisfying an equilibrium condition from the multi-channel compensation voltages and output the output module, realizing the compensation for the voltage difference between the two source drivers when determining that the data-driven signal output by the output module could not satisfy the equilibrium condition of the picture lightness. The present application solves the problem that the difference in the reference voltage value causes the voltage values output by the adjacent two Source-Chip on Films to be different, thereby causing a picture abnormality.

BRIEF DESCRIPTION OF THE DRAWINGS

In order to illustrate the technical schemes in the embodiments of the present application or in the prior art more clearly, the drawings which are required to be used in the description of the embodiments or the prior art are briefly described below. It is obvious that the drawings described below are only some embodiments of the present application. It is apparent to those of ordinary skill in the art that other drawings may be obtained based on the structures shown in accompanying drawings without inventive effort.

DESCRIPTION OF THE REFERENCE NUMERALS

Figure 1:
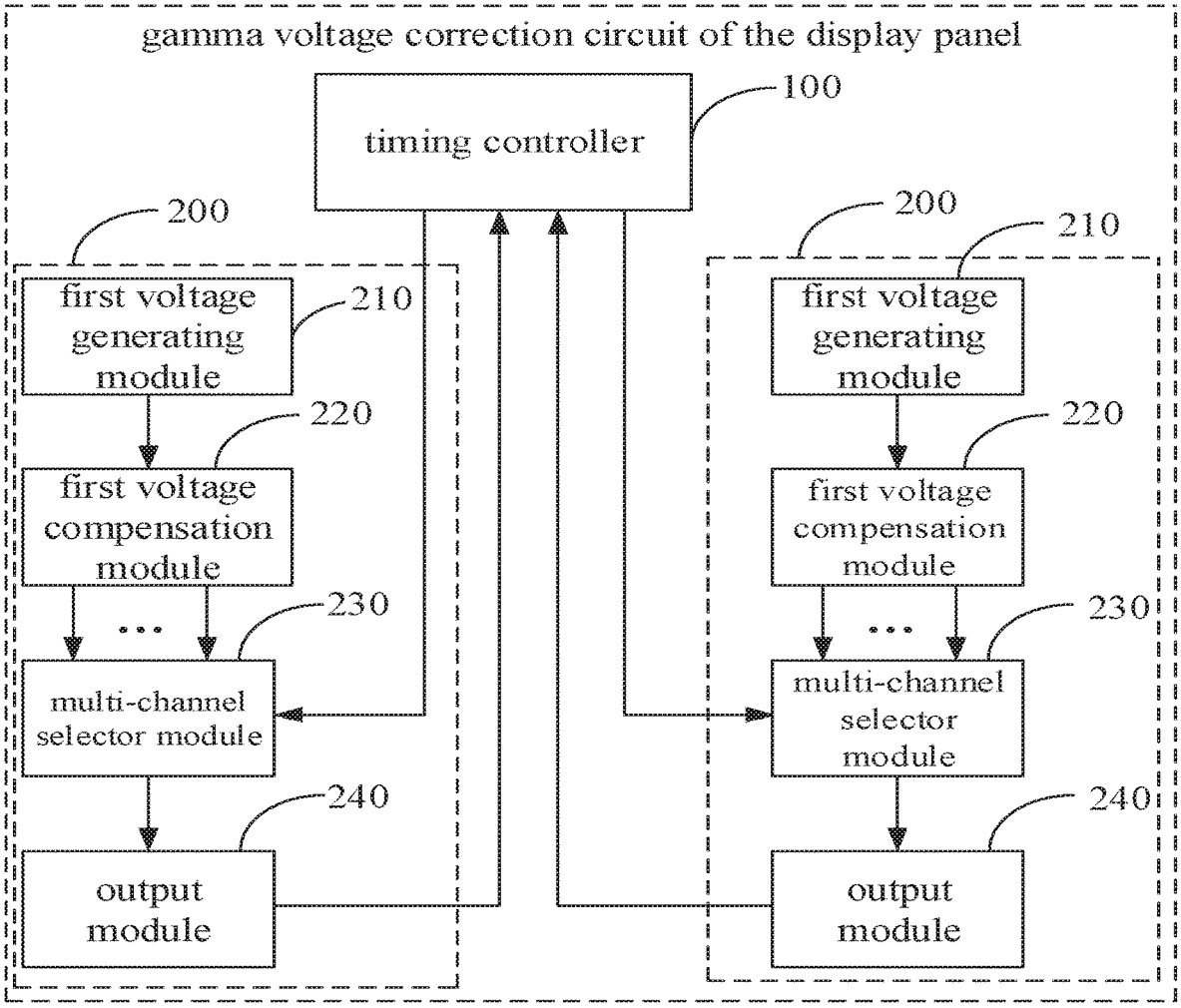
FIG. 1 is a functional block diagram of an embodiment of a gamma voltage correction circuit of a display panel of the present application.

| reference numeral | Name | reference numeral | Name |
|---|---|---|---|
| 100 | source driver | 240 | output module |
| 210 | first voltage generating module | S-COF1 | first source driver |
| 220 | first voltage compensation module | S-COF2 | second source driver |
| 230 | multi-channel selector module | | |

With reference to the drawings, the implement of the object, features and advantages of the present application will be further illustrated in conjunction with embodiments.

DETAILED DESCRIPTION OF THE EMBODIMENTS

The technical schemes of embodiments of the present disclosure will be clearly and completely described in the following with reference to the accompanying drawings. It is obvious that the embodiments to be described are only a part rather than all of the embodiments of the present disclosure. Based on the embodiments of the present application, all the other embodiments obtained by that of ordinary skill in the art without inventive effort are within the scope of the present application.

It should be noted that if the embodiments of the present application relates to directional indications (such as up, down, left, right, front, back, . . . ), they are only used to explain the relative positional relationship, motion situation and the like between components in a certain posture (as shown in the drawings), if the specific posture changes, the directional indication shall also change accordingly.

In addition, if the embodiments of the present application relates to the descriptions of "first", "second" and the like, they are only used for the purpose of description only, and are not to be construed as indicating or implying their relative importance or implicitly indicating the number of technical features indicated. Therefore, the characteristics indicated by the "first", the "second" can express or impliedly include at least one of the characteristics. In addition, the technical solutions between the various embodiments may be combined with each other, provided that those skilled in the art can implement it, and when the combination of the technical solutions is contradictory or impossible to implement, it should be considered that the combination of these technical solutions does not exist, nor is it within the scope of protection required by this application.

The present application proposes a gamma voltage correction circuit for use in a display device with a display panel such as a television, a mobile phone, or a computer.

In the display device, a plurality of source drivers are often provided, and each source driver can be provided as a Source-Chip on Film (S-COF), and the Source-Chip on Film is provided along one side of the display panel frame in order. The Source-Chip on Film is mainly used for receiving the digital video data signal and the control signal provided by the front end timing control panel TCON, and converting the digital signal into a corresponding analog gray-scale voltage signal according to the gamma voltage and inputting the analog gray-scale voltage signal to each sub-pixel of the display panel to drive the rotation of the liquid crystal molecules to achieve a change in the lightness of the projection light when the line scanning signal output by the gate driver controls the corresponding thin film transistor in the display panel to be conducted.

In order to ensure that the analog gray-scale voltage signal output by the Source-Chip on Film conforms to the viewing habit of human eyes, it is necessary to input a reference voltage to the Source-Chip on Film as a reference value of the voltage output. In the conventional architecture, an external gamma generating circuit that generates a reference voltage is disposed on the timing control panel. The same gamma reference voltage will be output to each Source-Chip on Film after it is generated by the gamma generating circuit. With the development of science and technology, the integration level of the driving architecture of the display panel is also getting higher and higher, and the first voltage generating module is also built in each Source-Chip on Film. That is to say, each Source-Chip on Film independently generates a gamma reference voltage. However, due to differences in semiconductor processes, reference voltage values generated by the first voltage generating modules in different Source-Chip on Films may also differ. The difference in the reference voltage value causes the voltage values output by the adjacent two Source-Chip on Films to be different, thereby causing a picture abnormality.

Figure 2:
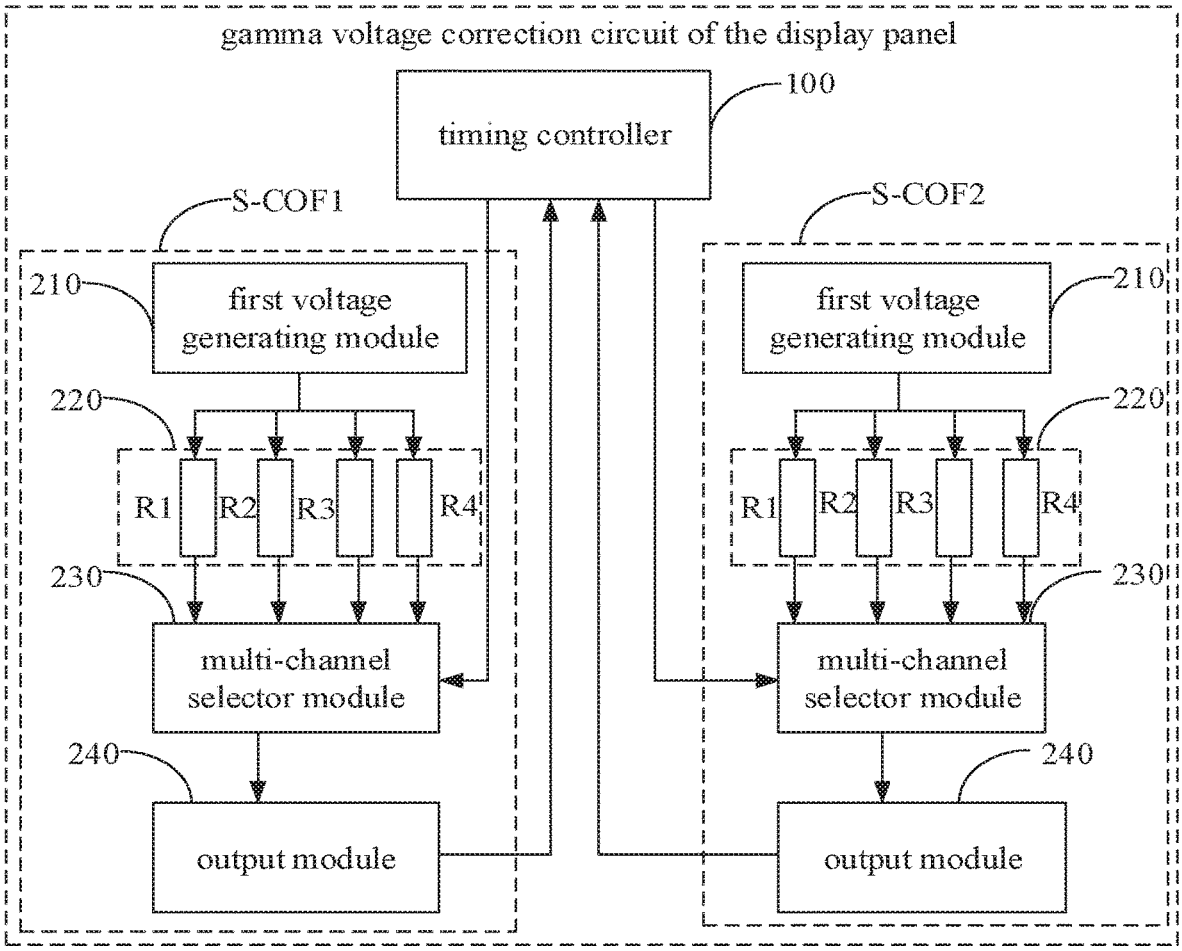
FIG. 2 is a schematic diagram of the circuit structure of an embodiment of a gamma voltage correction circuit of a display panel of the present application.

In order to solve the above problem, referring to FIG. 1 and FIG. 2, in an embodiment of the present application, the gamma voltage correction circuit includes:

a plurality of source drivers 200, each of the source drivers 200 includes a first voltage generating module 210, a first voltage compensation module 220, a multi-channel selector module 230, and an output module 240, the first voltage generating module 210 is configured to generate and output a multi-channel reference voltage;

the first voltage compensation module 220 is configured to generate and output a multi-channel compensation voltage according to one channel of the reference voltages;

the multi-channel selector module 230 is configured to output one channel of multi-channel compensation voltages;

the output module 240 is configured to output a corresponding data-driven signal according to the Nth compensation voltage; and a timing controller 100 configured to control the multi-channel selector module 230 to select a compensation voltage corresponding to a data-driven signal satisfying an equilibrium condition from the multi-channel compensation voltages and output it to the output module 240 when determining that the data-driven signal output by the output module 240 could not satisfy the equilibrium condition of the picture lightness.

In the present embodiment, the first voltage generating module 210, that is, the reference voltage generating module, can be implemented by using a resistor network string, and generating multiple gamma reference voltages by using the principle of the voltage dividing resistance in series or can be output by integrating a hardware into a circuit and integrating a software algorithm program into the source driver 200 to generate a plurality of gamma reference voltage through the encodeable gamma resistor network string. Among which the number of the gamma reference voltages generated by the first voltage generating module 210 may be 14 or 18.

The input end of the first voltage compensation module 220 is connected to an output end of a gamma reference voltage of the first voltage generating module 210, and is provided with a plurality of the compensation voltage output ends to output different compensation voltage values. The compensation voltage values can be proportionally disposed. The first voltage compensation module 220 can also be provided with 0 compensation voltage output end. When the reference voltage of the source driver 200 does not need to be compensated, the reference voltage output by the first voltage generating module 210 is directly output to the multi-channel selector module 230.

The multi-channel selector module 230 can be implemented by using an N select 1 multiplexer, or by a switch matrix composed of an N-type field-effect transistor, a P-type field-effect transistor, or a thin film transistor or other switch tubes. The controlled end of the multi-channel selector module 230 is connected to the timing controller 100 based on the control of the timing controller 100 to select a corresponding compensation voltage to output.

The output module 240 can be provided with circuit modules such as a bidirectional shift register, a data buffer, a level shifter, a digital to analog converter, and a multiplexer, wherein the bidirectional shift register adjust the output direction of the video data signal based on the control signal output by the timing controller 100. The data buffer is used to sample and register the input video data signal, and output to the next stage circuit. The level shifter causes the digital to analog converter to convert the digital data signal into an analog gray-scale voltage data signal according to the reference voltage in the current gray scale, and output it to the multiplexer after that by driving the field-effect transistor or the thin film transistor to turn on and off. The multiplexer has a plurality of output channels, and each output channel corresponds to a column of the display panel. When the gate driver conducts the thin film transistor of the display panel in the corresponding row, the multiplexer outputs the analog gray-scale voltage data signal to the corresponding sub-pixel to complete charging of each sub-pixel.

It can be understood that the timing controller 100 can distinguish the lightness or the voltage output by the output module 240 through the lightness acquisition device and the voltage acquisition device, in particular, obtain the lightness of the display area driven by each of the source drivers 200 of the display panel through the lightness acquisition device, and acquire any one channel of the data-driven signals of the source driver 200 through the voltage acquisition device. Wherein, the gamma voltage has a mapping relationship with the lightness of the display panel on each gray scale, and both can react through the voltage-lightness V-T curve. That is to say, under the current gray scale, the lightness of the display panel is obtained, and the magnitude of the gamma voltage can be obtained by the table look-up. The timing controller 100 can obtain the lightness of the display area driven by the adjacent two source drivers 200 on the display panel, or obtain the gray-scale voltage data signal on a data line output by adjacent the two source drivers 200 respectively, to determine whether the data-driven signal output by the output module 240 could satisfy the equilibrium condition of the picture lightness. When the equilibrium condition of the picture lightness is not satisfied, the timing controller 100 is output to the multi-channel selector module 230 of the corresponding source driver 200 to control the multi-channel selector module 230 to select and output a corresponding compensation voltage which is the compensation voltage of the data-driven voltage that could satisfy the equilibrium condition.

In some embodiments, the timing controller 100 can also obtain the temperature of the display panel by the temperature sensor and acquire the temperature distribution of the display panel by the temperature sensor to determine whether the data-driven signal output by the output module 240 could satisfy the equilibrium condition of the picture lightness, in particular, can display the existing signal acquisition module obtained, and output the acquired signal to the timing controller 100, so that the timing controller 100 determines, according to the feedback acquisition signal, whether the voltage value of the data-driven signal output by the current output module 240 could satisfy the equilibrium condition of the picture lightness.

In a specific implementation, the multi-channel selector module 230 can select a compensation voltage output by the output end of the 0 compensation voltage when the gamma voltage correction circuit starts to operate, that is, the multi-channel selector module 230 selects the reference voltage output by the first voltage generating module 210 and outputs to the output module 240, so that the output module 240 generates a data-driven signal according to the uncompensated reference voltage, and determines whether the data-driven signal output by the output module 240 could satisfy the equilibrium condition of the picture lightness by the timing controller 100.

The gamma voltage correction circuit of the present application passes through a plurality of source drivers 200, and each of the source drivers 200 is provided with a first voltage generating module 210, a first voltage compensation module 220, a multi-channel selector module 230 and an output module 240 to generate, by the first voltage generating module 210, a multi-channel reference voltage and output it to the first voltage compensation module 220, so that the first voltage compensation module 220 generates and outputs one channel of multi-channel compensation voltages according to the channel of the reference voltage output by the multi-channel selector module 230. Further, after one channel of the multi-channel compensation voltages is output by the multi-channel selector module 230, a video data signal output by the timing controller 100 is converted into a gray-scale voltage data signal by means of the output module 240 according to the compensation voltage, that is, output after the data-driven signal. The present application further controls the multi-channel selector module 230 of the corresponding source driver 200 to select a compensation voltage corresponding to a data-driven signal satisfying an equilibrium condition from the multi-channel compensation voltages and output the output module 240, realizing the compensation for the voltage difference between the two source drivers 200 by means of the timing controller 100 determining whether the data-driven signal output by the output module 240 could satisfy the equilibrium condition of the picture lightness and when determining that the data-driven signal output by the output module 240 could not satisfy the equilibrium condition of the picture lightness. The present application solves the problem that the difference in the reference voltage value causes the voltage values output by the adjacent two Source-Chip on Films to be different, thereby causing a picture abnormality.

Referring to FIG. 1 and FIG. 2, in an alternative embodiment, the timing controller 100 is specifically configured to:

determine whether the data-driven signal output by the output module 240 could satisfy the equilibrium condition of the picture lightness;

control the multi-channel selector module 230 of the corresponding source driver 200 to select another channel of compensation voltages from the multi-channel compensation voltage as the current compensation voltage to output to the output module 240, and return to continue to determine whether the data-driven signal output by the output module 240 could satisfy the equilibrium condition of the picture lightness until the multi-channel selector module 230 is controlled to select the compensation voltage corresponding to the data-driven signal satisfying the equilibrium condition from the multi-channel compensation voltages when determining that the data-driven signal output by the output module 240 could not satisfy the equilibrium condition of the picture lightness.

In the present embodiment, the multi-channel selector module 230 can select the 0 compensation voltage, that is, the first channel of compensation voltage for output, that is, in the initial stage of the gamma voltage correction of the display device, the first voltage compensation module 220 outputs the original gamma reference voltage rather than compensating the gamma reference voltage. Subsequently, the timing controller 100 determines whether the two data-driven signals satisfy the equilibrium condition of the picture lightness by detecting that the adjacent power drivers outputs a data-driven signal respectively. When not satisfied, the timing controller 100 controls the multi-channel selector module 230 to select the second compensation voltage for output, and continues to detect the data-driven signal output by the two power drivers respectively until the data-drive signal output by the output module 240 satisfy the equilibrium condition of the picture lightness. The compensation voltages output by the first voltage compensation module 220 can be proportionally disposed. For example, the second channel of compensation voltage B and the first channel of compensation voltage A can be characterized as: $B=A-X*10$, where X is a proportional number, X is greater than 1; 10 is the magnitude of the current output by the first voltage generating module 210. In other embodiments, the current corresponding to the source driver may also be disposed, which is not defined herein.

Referring to FIG. 1 and FIG. 2, in an alternative embodiment, the determining whether the data-driven signal output by the output module 240 could satisfy the equilibrium condition of the picture lightness is:

obtaining a data-driven signal output by adjacent two source drivers 200 respectively, and comparing the two data-driven signals obtained;

determining that the data-driven signal output by the output module 240 could not satisfy the equilibrium condition of the picture lightness when the voltage difference between the two data-driven signals is greater than the preset difference.

In the present embodiment, the adjacent two source drivers 200 can be sequentially provided along the display panel in order and adjacent to the two source drivers 200. Each source driver 200 has N outputs, where Output N is characterized by a final channel of output of one source driver 200, and Output N+1 is characterized by the first channel of output of the other source driver 200, namely Output N and Output N. +1 are outputs of adjacent positions on the display panel. The timing controller 100 can acquire the data-driven signals of Output N and Output N+1 as outputs of adjacent positions on the display panel and compare the voltage values of the two data-driven signals. It can be determined that the data-driven signal output by the output module 240 could not satisfy the equilibrium condition of the picture lightness when the voltage difference between the two data-driven signals is greater than the preset difference. Of course, in other embodiments, the data-driven signals output by any one channel of the two source drivers 200 may also be selected, which is not defined herein.

Referring to FIG. 1 and FIG. 2, in an alternative embodiment, the timing controller 100 is specifically configured to:

determine whether the data-driven signal output by the output module 240 could satisfy the equilibrium condition of the picture lightness;

determine a corresponding compensation voltage value, and control the multi-channel selector module 230 of the corresponding source driver 200 to select a compensation voltage matching the compensation voltage value from the multi-channel compensation voltage according to the compensation voltage value and output it to the output module 240 when determining that the data-driven signal output by the output module 240 could not satisfy the equilibrium condition of the picture lightness.

In the present embodiment, a person skilled in the art can implement control of the multi-channel selector module 230 by integrating some hardware circuits and software programs or algorithms in the timing controller 100, for example, integrating an ADC conversion circuit, a comparator, and other hardware circuits or a software algorithm program for analyzing the received data-driven signals. Converting the analog data-driven signal into a digital signal by running or executing a software program and/or module stored in the memory, and recalling data stored in the memory, and an ADC conversion circuit integrated in the timing controller 100, and comparing and analyzing the data-driven signal converted into a digital signal by the software algorithm program and/or the hardware circuit module integrated in the timing controller 100, to search the compensation voltage value corresponding to the data-driven signal after obtaining the difference value by the data-driven signal according to the mapping relationship between the compensation voltage value and the data-driven signal so that the multi-channel selector module 230 of the source driver 200 that needs to be adjusted in the adjacent two source drivers 200, and the corresponding compensation voltage value are determined when determining that the data-driven signal output by the output module 240 could not satisfy the equilibrium condition of the picture lightness. Whereafter, the timing controller 100 can control the multi-channel selector module 230 to select the branch conduction corresponding to the compensation voltage value, so as to output the gamma voltage corresponding to the compensation voltage value to the output module 240, thereby causing the output module 240 to convert the received video data voltage signal into a gray-scale voltage data signal and output it according to the gamma voltage.

Referring to FIG. 1 and FIG. 2, in an alternative embodiment, the number of the first voltage compensation modules 220 is multiple, and each of the first voltage compensation modules 220 is disposed in series between one output end of one channel of reference voltages of the first voltage generating module 210 and the multi-channel selector module 230.

It can be understood that the number of the gamma reference voltages generated by the first voltage generating module 210, ie., the number of the original gamma voltages, may be 14 or 18. The source driver 200 is further provided with a gamma circuit, and can further generate multi-channel gamma voltages according to the 14th channel, in particular, can be provided according to the number of the gray scale of the display panel, that is, each gray scale of the display panel is correspondingly provided with one gamma voltage. In the present embodiment, the number of the first voltage compensation module 220 can be arranged to 14 and set corresponding to the gamma reference voltage generated by the first voltage generating module 210. When the gamma voltage is debugged, the display panel can be controlled and fixed under the gray scale corresponding to the 14th gamma voltage.

Referring to FIG. 1 and FIG. 2, in an alternative embodiment, the first voltage compensation module 220 includes a plurality of compensation resistors (not shown), and one end of the plurality of compensation resistors is connected to the first voltage generating module 210, and the other end of the plurality of compensation resistors is connected to the output ends of the multi-channel selector module 230 one by one; the resistance values of the plurality of compensation resistors are proportionally disposed.

In the present embodiment, the number of compensation resistors may be one or more, and may be set according to the accuracy of the gamma voltage correction circuit, and the accuracy of the gamma voltage correction circuit may be increased as the number of compensation resistors increases, that is, the more the number of compensation resistors is set, the higher the compensation accuracy will be. In the present embodiment, the number of compensation resistors is set to four, and are respectively labeled as compensation resistors R1~R4. Wherein, the resistance value of R1 can be set to 0 ohm, and those of R2, R3, and R4 are set according to the actual calibration accuracy. The resistance values of a plurality of compensation resistors can be set proportionally or in equal difference. In an embodiment, when the output current of the reference generation module is 10 mA, the resistance values of R2, R3, and R4 can be set to 0.4 ohms, 0.8 ohms, and 1.2 ohms respectively; that is, the same reference voltage is output to A after passing through R1, and output to A-10 mA*0.4 after passing through R2, and output to A-10 mA*0.8 after passing through R3, and output to A-10 mA*1.2 after passing through R4.

In order to better explain the inventive concept of the present application, the working principle of the gamma voltage correction circuit of the present application will be described below with reference to FIG. 1 and FIG. 2:

In the present embodiment, two source drivers 200 are taken as an example, and adjacent two source drivers 200 are defined as a first source driver S-COF1 and a second source driver S-COF2, and Output N is characterized by the last channel of output of the first source driver S-COF1, and Output N+1 is characterized by the first channel of output of the second source driver S-COF2.

In the initial state, the adjacent two source drivers 200 and the corresponding multi-channel selector module 230 corresponding to the current gray scale strobe the loop corresponding to R1, that is, the output paths of the two source drivers 200 are the voltages output by the reference voltage module, which is output to the input module 240 after passing through R1, and then converted into a gray-scale voltage data signal and output to the display panel. Under the current gray scale, the timing controller 100 detects the data-driven signals of Output N and Output N+1 corresponding to the source driver 200 respectively. When the voltage difference between Output N and Output N+1 is less than the threshold (the threshold voltage may be 15 mV in the present embodiment), the timing controller 100 does not adjust the multi-channel selector module 230 at this time.

When the voltage difference between Output N and Output N+1 is greater than the threshold, and the output of the second source driver S-COF2 is greater than that of the first source driver S-COF1, then TCON adjusts the multi-channel selector module 230 of the second source driver S-COF2, and the multi-channel selector module 230 in the second source driver S-COF2 strobes the loop corresponding to R2. That is, the output path of the first source driver S-COF1 is the data-driven signal output by the reference voltage module, and is input to the output module 240 after passing through R1. While the output path of the second source driver S-COF2 is input to the output module 240 after passing through R2. The timing controller 100 continues to detect the data-driven signals of Output N and Output N+1, and if the voltage difference is still greater than the threshold, it is respectively adjusted to R3 and R4 for output until the voltage difference between Output N and Output N+1 is less than threshold as the above processes.

Similarly, if the voltage difference between Output N and Output N+1 is greater than the threshold, and the output of the first source driver S-COF1 is greater than that of the first second driver S-COF2, then the multi-channel selector module 230 of the first source driver S-COF1 is adjusted as the above principle and will not be repeated here.

The present invention further proposes a gamma reference voltage correction method.

Figure 3:
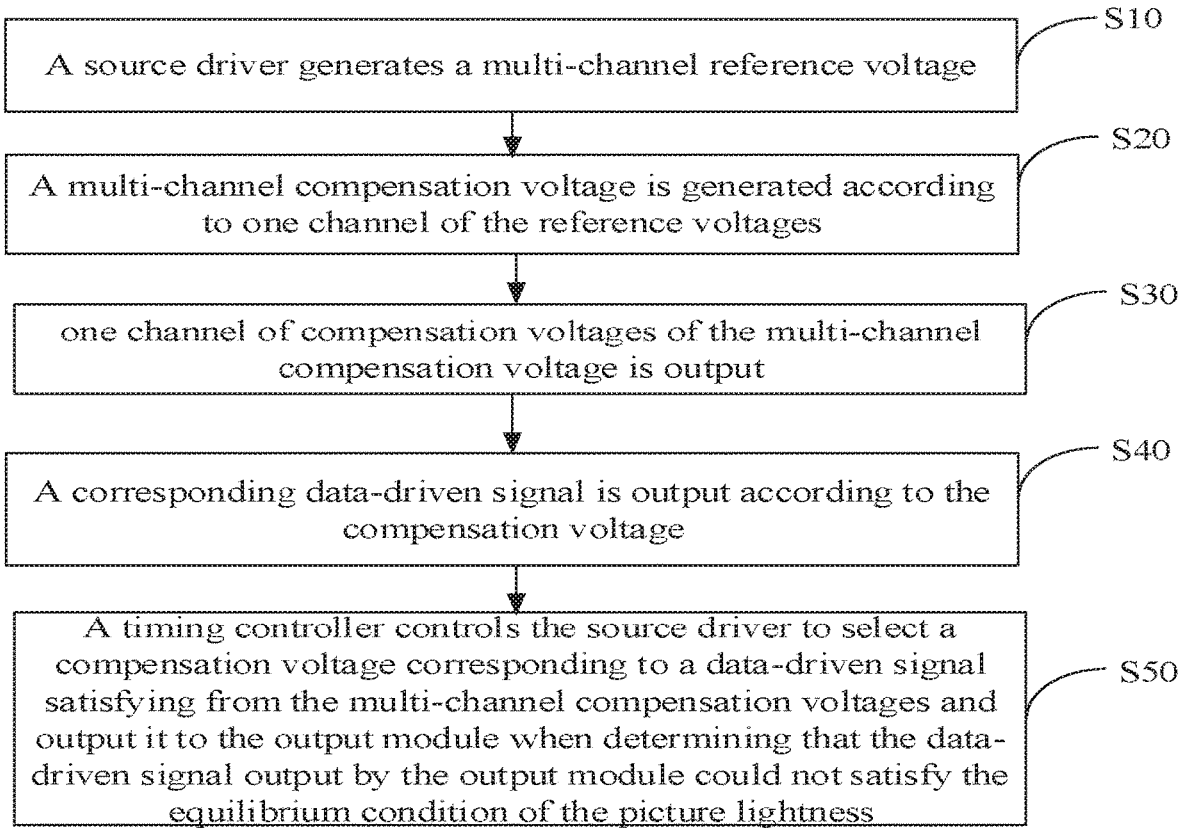
FIG. 3 is a process diagram of an embodiment of a gamma voltage correction method of a display panel of the present application.

Referring to FIG. 3, the gamma reference voltage correction method includes the following steps:

S10. A source driver generates a multi-channel reference voltage;

S20. A multi-channel compensation voltage is generated according to one channel of the reference voltages;

S30. One channel of compensation voltages of the multi-channel compensation voltage is output;

S40. A corresponding data-driven signal is output according to the compensation voltage;

S50. A timing controller controls the source driver to select a compensation voltage corresponding to a data-driven signal satisfying from the multi-channel compensation voltages and output it to the output module when determining that the data-driven signal output by the output module could not satisfy the equilibrium condition of the picture lightness.

It can be understood that the gamma reference voltage correction method can be applied to the above gamma voltage correction circuit, the gamma voltage correction circuit includes a timing controller, a source driver, and the source driver further includes a first voltage generating module, the first voltage compensation module, a multi-channel selector module and an output module and other circuit modules. Refer to the above embodiments of the gamma voltage correction circuit for the specific working process of the source driver and will not be repeated here. Moreover, the gamma reference voltage correction method is applied to the gamma voltage correction circuit as described above, including but not limited to the gamma voltage correction circuit of the present application.

The gamma voltage correction method of the present application determines whether the data-driven signal output by the output module could satisfy the equilibrium condition of the picture lightness by the timing controller and controls the multi-channel selector module of the corresponding source driver to select a compensation voltage corresponding to a data-driven signal satisfying an equilibrium condition from the multi-channel compensation voltages and output the output module, realizing the compensation for the voltage difference between the two source drivers when determining that the data-driven signal output by the output module could not satisfy the equilibrium condition of the picture lightness. The present application solves the problem that the difference in the reference voltage value causes the voltage values output by the adjacent two Source-Chip on Films to be different, thereby causing a picture abnormality.

In the above embodiments, the steps of the timing controller controlling a source driver to select and output a compensation voltage corresponding to a data-driven signal satisfying an equilibrium condition from the multi-channel compensation voltages when determining that the data-driven signal could not satisfy the equilibrium condition of the picture lightness includes:

determining, the timing controller, whether the data-driven signal output by the output module could satisfy the equilibrium condition of the picture lightness;

control the multi-channel selector module of the corresponding source driver to select one channel of compensation voltages from the multi-channel compensation voltage as the current compensation voltage to output to the output module, and return to continue to determine whether the data-driven signal output by the output module could satisfy the equilibrium condition of the picture lightness until the multi-channel selector module is controlled to select the compensation voltage corresponding to the data-driven signal satisfying the equilibrium condition from the multi-channel compensation voltages when determining that the data-driven signal output by the output module could not satisfy the equilibrium condition of the picture lightness.

Further, in the above embodiments, the determining whether the data-driven signal output by the output module could satisfy the equilibrium condition of the picture lightness is:

obtaining a data-driven signal output by adjacent two source drivers respectively, and comparing the two data-driven signals obtained;

determining that the data-driven signal output by the output module of the source driver could not satisfy the equilibrium condition of the picture lightness when the voltage difference between the two data-driven signals is greater than the preset difference.

Further, in the above embodiments, the steps of the timing controller controlling a source driver to select and output a compensation voltage corresponding to a data-driven signal satisfying an equilibrium condition from the multi-channel compensation voltages when determining that the data-driven signal could not satisfy the equilibrium condition of the picture lightness includes:

determining whether the data-driven signal output by the output module of the source driver could satisfy the equilibrium condition of the picture lightness;

determining a corresponding compensation voltage value, and control the multi-channel selector module of the corresponding source driver to select a compensation voltage matching the compensation voltage value from the multi-channel compensation voltage according to the compensation voltage value and output it to the output module when determining that the data-driven signal output by the output module could not satisfy the equilibrium condition of the picture lightness.

The present application also proposes a display device including a display panel and a gamma voltage correction circuit as described above. The detailed structure of the gamma voltage correction circuit can be referred to the above embodiment and will not be repeated here. It can be understood that since the gamma voltage correction circuit is used in the display device of the present application, the embodiments of the display device of the present application include all the technical solutions of all the embodiments of the gamma voltage correction circuit described above, and the technical effects achieved are also completely the same, and will not be repeated here.

Data lines of the display panel and the plurality of the source driver chips of the gamma voltage correction circuit are connected to each other respectively.

The above mentioned is only the alternative embodiment of the present invention, which does not limit the patent scope of the present invention, and any equivalent structure transformation made by using the specification and the drawings of the present invention or direct/indirect applications in other related technical fields should be contained in the scope of patent protection in a similar way.

What is claimed is:

1. A gamma voltage correction circuit, comprising:

a plurality of source drivers, each of the source drivers includes a first series of resistors, a first compensation resistor, a multi-channel selector, and an output, wherein the multi-channel selector is any one or combination selected from a group consisting of an N select 1 multiplexer, a switch matrix composed of an N-type field-effect transistor, a P-type field-effect transistor, or a thin film transistor;

the output is any one or combination selected from a group consisting of a bidirectional shift register, a data buffer, a level shifter, a digital to analog converter, or a multiplexer;

the first series of resistors is configured to generate and output multi-channel reference voltages;

the first compensation resistor is configured to generate and output multi-channel compensation voltages according to one channel of the reference voltages;

the multi-channel selector is configured to output one channel of compensation voltages of the multi-channel compensation voltages;

the output is configured to output a corresponding data-driven signal according to a compensation voltage output by the multi-channel selector; and a timing controller configured to control the multi-channel selector to select the compensation voltage corresponding to a data-driven signal satisfying an equilibrium condition from the multi-channel compensation voltages and output the compensation voltage to the output when determining the data-driven signals output by the output could not satisfy the equilibrium condition of the picture lightness, and wherein the timing controller is configured to:

determine whether the data-driven signal output by the output could satisfy the equilibrium condition of the picture lightness; and control the multi-channel selector of the corresponding source driver to select another channel of compensation voltages from the multi-channel compensation voltages as the current compensation voltage to output to the output, and return to continue to determine whether the data-driven signal output by the output could satisfy the equilibrium condition of the picture lightness until the multi-channel selector is controlled to select a compensation voltage corresponding to the data-driven signal satisfying the equilibrium condition from the multi-channel compensation voltages when determining that the data-driven signal output by the output could not satisfy the equilibrium condition of the picture lightness.

2. The gamma voltage correction circuit according to claim 1, wherein the determining whether the data-driven signal output by the output could satisfy the equilibrium condition of the picture lightness is specifically:

obtaining a data-driven signal output by two source drivers of the plurality of source drivers respectively, and calculating the difference between the obtained voltage values of the two data-driven signals; and determining that the data-driven signal output by the output could not satisfy the equilibrium condition of the picture lightness when the voltage difference between the two data-driven signals is greater than the preset difference.

3. The gamma voltage correction circuit according to claim 1, wherein the timing controller is specifically configured to:

determine whether the data-driven signal output by the output could satisfy the equilibrium condition of the picture lightness;

determine a corresponding compensation voltage value, and control the multi-channel selector of the corresponding source driver to select a compensation voltage matching the compensation voltage value from the multi-channel compensation voltages according to the compensation voltage value and output the compensation voltage to the output when determining that the data-driven signal output by the output could not satisfy the equilibrium condition of the picture lightness.

4. The gamma voltage correction circuit according to claim 1, wherein the first compensation resistor comprises a plurality of compensation resistors, and one end of the plurality of compensation resistors is connected to the first series of resistors, and the other end of the plurality of compensation resistors is connected to the output ends of the multi-channel selector one by one; the resistance values of the plurality of compensation resistors are proportionally disposed.

5. The gamma voltage correction circuit according to claim 4, wherein the number of the compensation resistors is set to four.

6. The gamma voltage correction circuit according to claim 5, wherein the resistance value of any one of the four compensation resistors is 0 ohm.

7. The gamma voltage correction circuit according to claim 4, wherein each compensation voltage output by the first compensation resistor is proportionally disposed.

8. A gamma reference voltage correction method, comprising the steps of:

generating multi-channel reference voltages by a source driver;

generating multi-channel compensation voltages according to one channel of the reference voltages;

outputting one channel of compensation voltages of the multi-channel compensation voltages;

outputting a corresponding data-driven signal according to the compensation voltage; and controlling, by the timing controller, a source driver to select the compensation voltage corresponding to a data-driven signal satisfying an equilibrium condition from the multi-channel compensation voltages and outputting the compensation voltage when determining that the data-driven signal could not satisfy the equilibrium condition of the picture lightness, and wherein the step of controlling, by the timing controller, a source driver to select and output the compensation voltage corresponding to a data-driven signal satisfying an equilibrium condition from the multi-channel compensation voltages when determining that the data-driven signal could not satisfy the equilibrium condition of the picture lightness comprises:

determining, the timing controller, whether the data-driven signal output by an output could satisfy the equilibrium condition of the picture lightness; and controlling a multi-channel selector of the corresponding source driver to select one channel of compensation voltages from the multi-channel compensation voltages as the current compensation voltage to output to the output of the source driver, and returning to continue to determine whether the data-driven signal output by the output could satisfy the equilibrium condition of the picture lightness, until the multi-channel selector is controlled to select the compensation voltage corresponding to the data-driven signal satisfying the equilibrium condition from the multi-channel compensation voltages when determining that the data-driven signal output by the output could not satisfy the equilibrium condition of the picture lightness.

9. The gamma reference voltage correction method according to claim 8, wherein the determining whether the data-driven signal output by the output could satisfy the equilibrium condition of the picture lightness is specifically:

obtaining a data-driven signal output by adjacent two source drivers respectively, and comparing the two data-driven signals obtained; and determining that the data-driven signal output by the output could not satisfy the equilibrium condition of the picture lightness when the voltage difference between the two data-driven signals is greater than the preset difference.

10. The gamma reference voltage correction method according to claim 8, wherein the step of controlling, by the timing controller, a source driver to select and output a compensation voltage corresponding to a data-driven signal satisfying an equilibrium condition from the multi-channel compensation voltages when determining that the data-driven signal could not satisfy the equilibrium condition of the picture lightness comprises:

determining whether the data-driven signal output by the output of the source driver could satisfy the equilibrium condition of the picture lightness; and determining a corresponding compensation voltage value, and control the multi-channel selector of the corresponding source driver to select a compensation voltage matching the compensation voltage value from the multi-channel compensation voltage according to the compensation voltage value and output the compensation voltage to the output when determining that the data-driven signal output by the output could not satisfy the equilibrium condition of the picture lightness.

11. The gamma reference voltage correction method according to claim 8, wherein each compensation voltage is proportionally disposed.

12. A display device, comprising: a display panel and a gamma voltage correction circuit of the display panel according to claim 1, a plurality of data lines of the display panel and a plurality of the source driver chips of the gamma voltage correction circuit are connected to each other respectively;

the gamma voltage correction circuit comprises:

a plurality of source drivers, each of the source drivers includes a first series of resistors, a first compensation resistor, a multi-channel selector, and an output, the first series of resistors is configured to generate and output multi-channel reference voltages;

the first compensation resistor is configured to generate and output multi-channel compensation voltages according to one channel of the reference voltages;

the multi-channel selector is configured to output one channel of compensation voltages of the multi-channel compensation voltages;

the output is configured to output a corresponding data-driven signal according to a compensation voltage output by the multi-channel selector; and a timing controller configured to control the multi-channel selector to select the compensation voltage corresponding to a data-driven signal satisfying an equilibrium condition from the multi-channel compensation voltages and output the compensation voltage to the output when determining the data-driven signals output by the output could not satisfy the equilibrium condition of the picture lightness, and wherein the timing controller is specifically configured to:

determine whether the data-driven signal output by the output could satisfy the equilibrium condition of the picture lightness; and control the multi-channel selector of the corresponding source driver to select another channel of compensation voltages from the multi-channel compensation voltages as the current compensation voltage to output to the output, and return to continue to determine whether the data-driven signal output by the output could satisfy the equilibrium condition of the picture lightness, until the multi-channel selector is controlled to select a compensation voltage corresponding to the data-driven signal satisfying the equilibrium condition from the multi-channel compensation voltages when determining that the data-driven signal output by the output could not satisfy the equilibrium condition of the picture lightness.

13. The display device according to claim 12, wherein the determining whether the data-driven signal output by the output could satisfy the equilibrium condition of the picture lightness is specifically:

obtaining a data-driven signal output by two source drivers of the plurality of source drivers respectively, and calculating the difference between the obtained voltage values of the two data-driven signals; and determining that the data-driven signal output by the output could not satisfy the equilibrium condition of the picture lightness when the voltage difference between the two data-driven signals is greater than the preset difference.

14. The display device according to claim 12, wherein the timing controller is specifically configured to:

determine whether the data-driven signal output by the output could satisfy the equilibrium condition of the picture lightness; and determine a corresponding compensation voltage value, and control the multi-channel selector of the corresponding source driver to select a compensation voltage matching the compensation voltage value from the multi-channel compensation voltage according to the compensation voltage value and output the compensation voltage to the output when determining that the data-driven signal output by the output could not satisfy the equilibrium condition of the picture lightness.

15. The display device according to claim 12, wherein the first compensation resistor comprises a plurality of compensation resistors, and one end of the plurality of compensation resistors is connected to the first series of resistors, and the other end of the plurality of compensation resistors is connected to the output ends of the multi-channel selector one by one; the resistance values of the plurality of compensation resistors are proportionally disposed.

* * * * *